United States Patent [19]

Taylor

[11] Patent Number: 5,042,210

[45] Date of Patent: Aug. 27, 1991

[54] GLASS-BLOCK PANELS AND METHOD OF FABRICATION THEREOF

[75] Inventor: John R. Taylor, Irving, Tex.

[73] Assignee: Innovative Building Products, Inc., Irving, Tex.

[21] Appl. No.: 368,120

[22] Filed: Jun. 16, 1989

Related U.S. Application Data

[63] Continuation of Ser. No. 236,169, Aug. 25, 1988, abandoned.

[51] Int. Cl.[5] ..... E04C 1/42

[52] U.S. Cl. ..... 52/307; 52/656

[58] Field of Search ..... 52/200, 307, 308, 384, 52/387, 235, 656

[56] References Cited

U.S. PATENT DOCUMENTS 2,198,450 4/1940 Chertkof ..... 52/200

2,199,244 4/1940 Mulford ..... 52/307

2,835,623 5/1958 Vincent et al. ..... 52/308 X 4,924,649 5/1990 Taylor ..... 52/656

OTHER PUBLICATIONS

Accu Speed, Glass Block Connectors.

*Primary Examiner*—Henry E. Raduazo

*Assistant Examiner*—Creighton Smith

*Attorney, Agent, or Firm*—Kenneth R. Glaser

[57] ABSTRACT

A glass block panel construction and method of fabrication useful for decorative and functional purposes. The panel includes a frame rigidly assembled from interlocking components to form a grid-like pattern of adjacent pockets, each pocket sized to receive and support a glass block by way of support lips extending around each pocket, the blocks bonded to the frame and therefore to one another in structurally stable and weather sealed relation.

14 Claims, 9 Drawing Sheets

FIG. 8
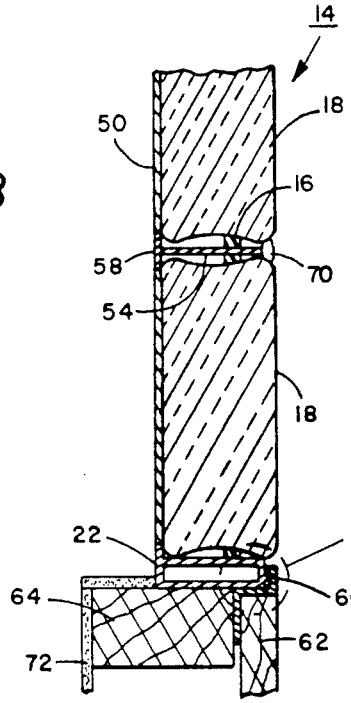
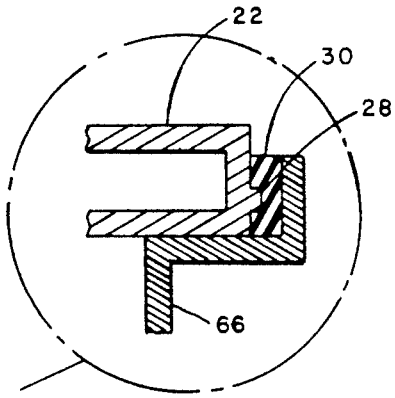
FIG. 9
FIG. 10
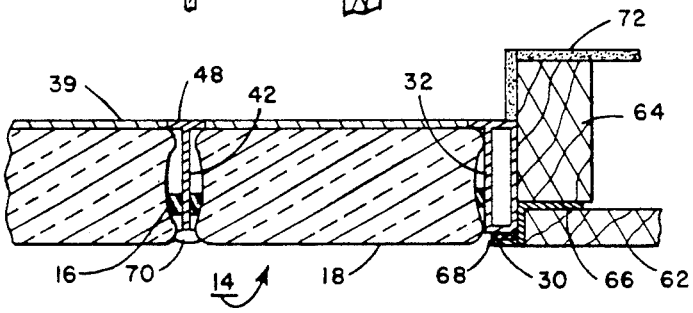
FIG. 13
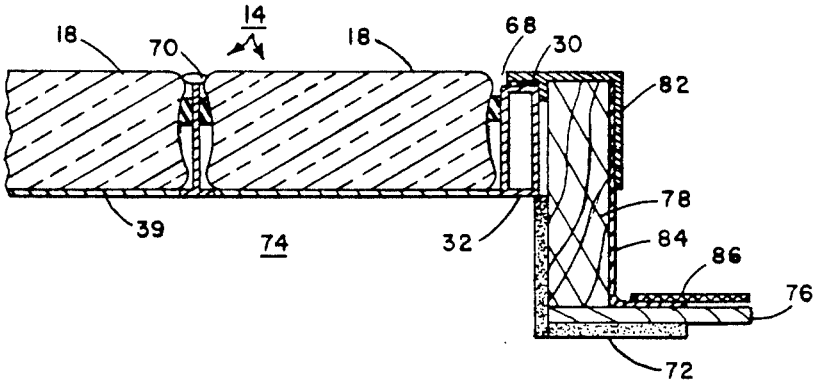
FIG. 12
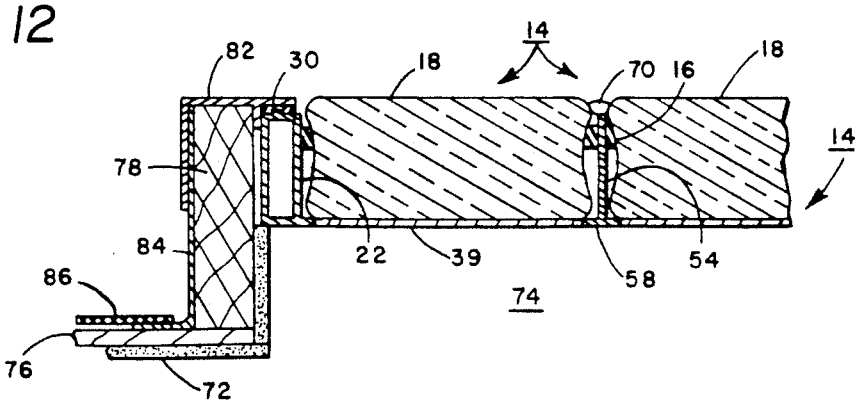

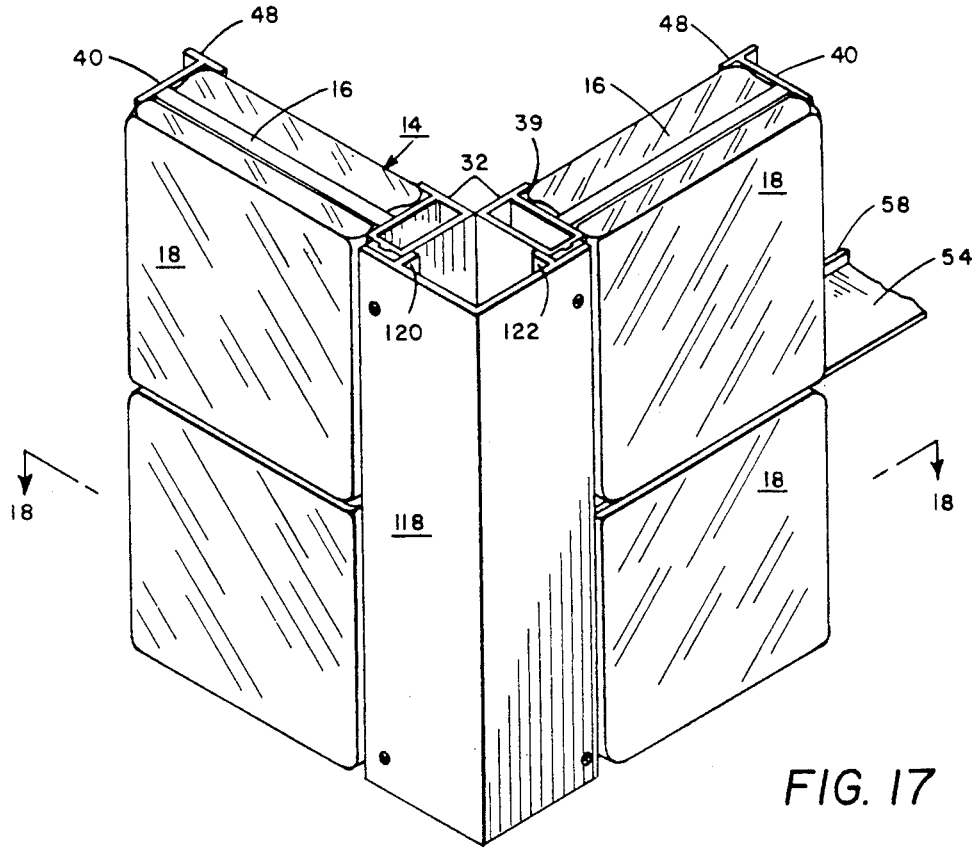
FIG. 17
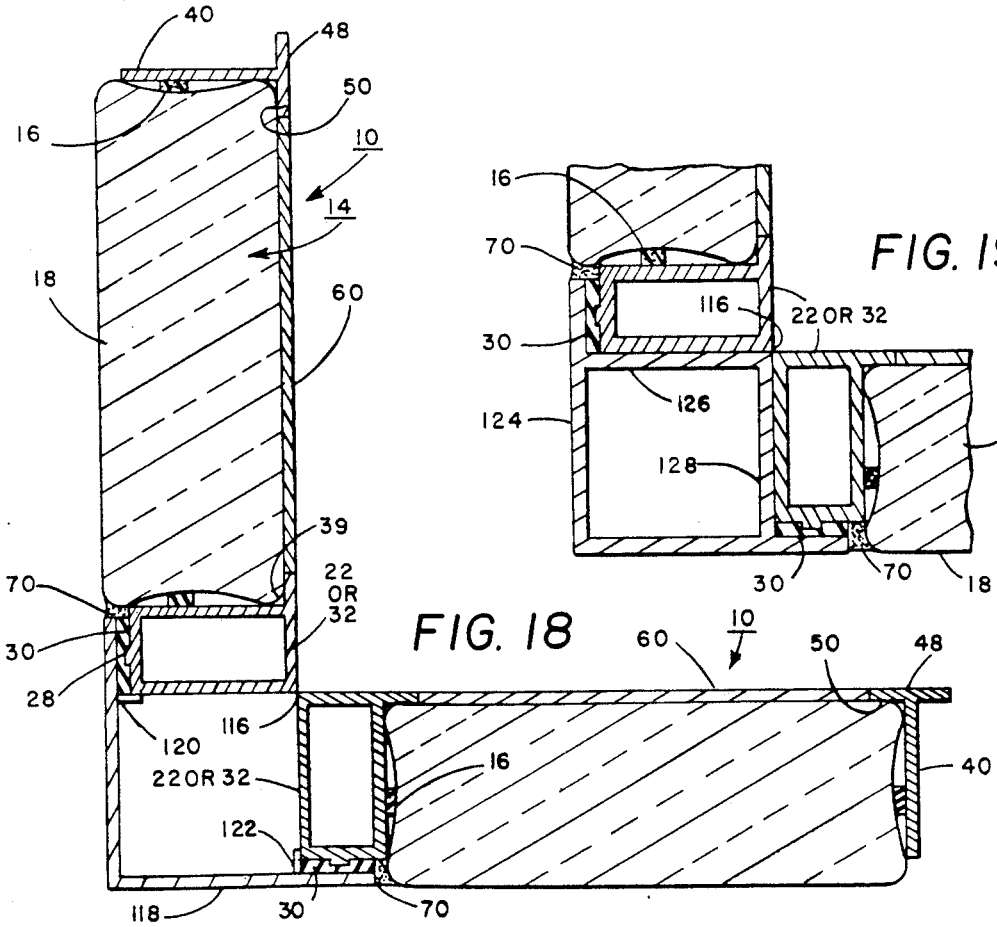
FIG. 18
FIG. 19

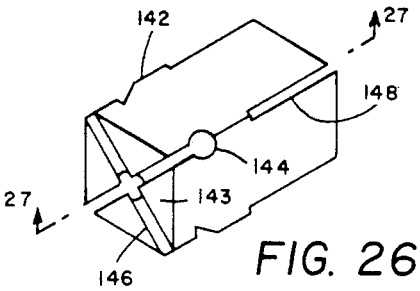
FIG. 26
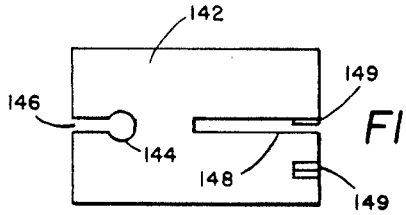
FIG. 27
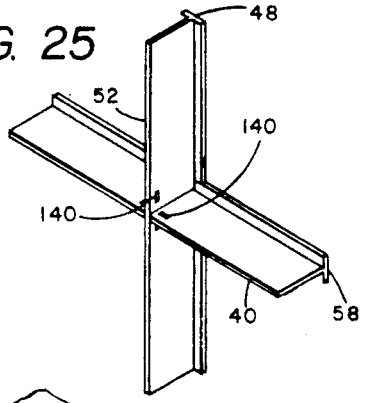
FIG. 25
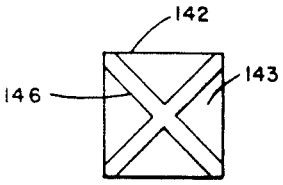
FIG. 28
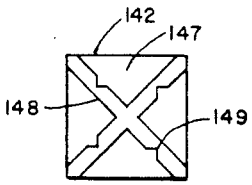
FIG. 29
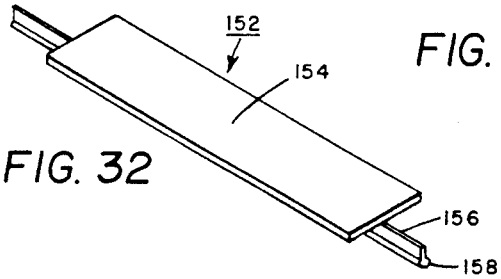
FIG. 32
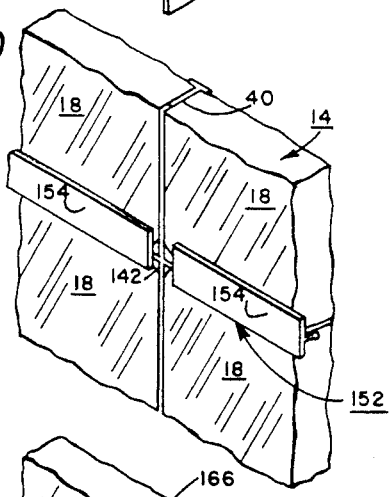
FIG. 30
FIG. 33
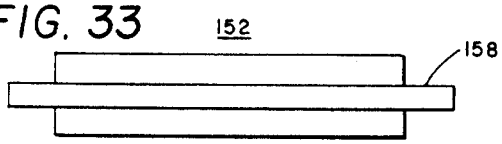
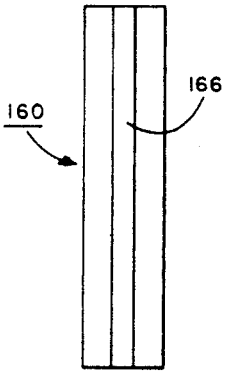
FIG. 35
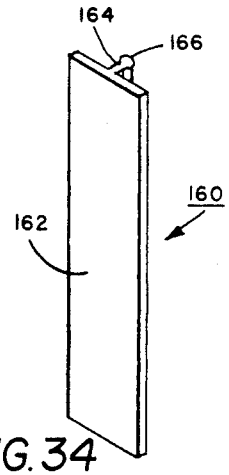
FIG. 34
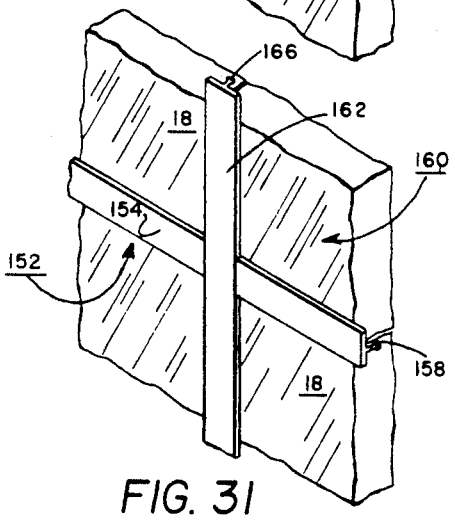
FIG. 31

GLASS-BLOCK PANELS AND METHOD OF FABRICATION THEREOF

This is a continuation of co-pending application Ser. No. 236,169 filed on 08/25/88 now abandoned.

TECHNICAL FIELD

The field of art to the which the invention pertains comprises the art of building construction utilizing glass blocks installed as panels for decorative and/or functional purposes, such as windows, skylights, and the like.

BACKGROUND OF THE INVENTION

Glass blocks or "bricks" have been widely used in the domestic and commercial building trades for several decades. When installed, the blocks are commonly clustered in a panel in various distinctive geometric patterns, the panel being disposed within a wall formed of conventional brick, block or framing. Their aesthetic attractiveness has been a major factor contributing toward their enduring popularity for both interior and exterior walls. In addition, by virtue of their translucence, the glass blocks effectively serve as windows for transmission of daylight.

BACKGROUND OF THE PRIOR ART

Glass blocks suitable for the building trades have been available in a variety of different sizes and shapes, from various commercial sources. They have been utilized, in selected sections of a wall, along with regular brick or block which form the remaining portions of the wall. Since the glass block has traditionally been categorized as brick, installation of these glass blocks has normally been subject to the same, and in many situations more, cumbersome practices and standards as required for mortar installation of conventional clay brick.

In addition, while the glass block's attractiveness and style have assisted in maintaining its popularity, there are nevertheless undesirable traits and characteristics associated with the glass block that have in the past detracted and prevented its more extensive use. Among these undesirable traits has been the tendency of misalignment between adjacent mortar installed blocks, typically due to settling or mortar squeeze, which therefore detracts from the finished appearance of the installation. Furthermore, since the mortar has essentially no elasticity, settlement can cause cracking of the blocks. Additionally, realignment and replacement of the installed blocks have proved expensive and impractical by virtue of the difficulties associated with attempted realignment and the likelihood that existing blocks will be destroyed during any replacement process. Moreover, the labor intensity associated with such projects makes correction procedures quite costly. Furthermore, glass blocks have heretofore never been regarded as useful for overhead applications, such as skylights, due at least in part to its lack of competitiveness with other systems.

OBJECTS OF THE INVENTION

It is therefore an object of the invention to provide a new and improved panel construction and assembly for the support and installation of glass blocks.

It is a further object of the invention to effect the previous object with a construction which significantly increases the structural integrity of an installed glass block panel while maintaining an appearance superior to that achieved by masonry procedures.

It is yet another object of the invention to achieve substantial cost reductions for effecting glass block installations while substantially minimizing, if not entirely eliminating, the undesirable traits associated with prior art glass block installations.

SUMMARY OF THE INVENTION

In accordance with these and other objects, the present invention relates to a construction of glass blocks in a novel assembled panel relation which provides individual support for each block of the panel, and affords enhanced structural integrity of the installed panel. In accordance with one feature of the invention, each block is independently supported with respect to the adjacent blocks, the resulting enhanced structural integrity thus increasing its suitability for any desired installation, including overhead installations such as skylights.

The foregoing is achieved in accordance with the invention by means of a frame formed of transversely intersecting, interlocking components, providing a matrix support for the array of glass blocks. Because the frame components removably interfit, assembly of the frame can be effected in advance of shipment or alternatively, on-site, to form a grid pattern of suitable overall configuration and dimension which, along with the supported glass blocks, correspond to the overall panel to be installed. Specifically, a plurality of individual adjacently disposed pockets are defined by the assembled frame, with each pocket sized and shaped to respectively closely receive and support any standard size of commercially available glass block in a controlled separation from the adjacent blocks. Each pocket includes, at its base, a peripheral lip extending inward of, and around the circumference of, the pocket, thus in essence defining a shelf for supporting the glass block. The pocket shelf, in combination with the framework defining the grid pocket, supports each block at five of its six faces with the front face being exposed. Then, by applying caulking about the outer edges of each block in the intervening space between the in-place blocks and the frame packet, all of the blocks are bonded securely to the frame and therefore joined together in a structurally sound and weather sealed relation and present an appearance meeting and exceeding the most expensive of masonry installations.

Being pre-assembled as a panel in the foregoing manner, post-installation misalignment and settling problems previously associated with glass block installations of the prior art are avoided. Without the need to permit mortar set before layers of block are added, and without the need for skilled labor to effect assembly, a highly significant reduction of installation time and costs is readily realized. Yet by virtue of the increased structural integrity which the system hereof affords, the assembly can quite readily be utilized for many applications not previously considered possible for glass block assemblies.

Additional features and advantages of the invention, as well as other superior aspects thereof, will become readily apparent and appreciated by those skilled in the art by reference to the following detailed description taken in conjunction with the drawings.

BRIEF DESCRIPTION OF THE DRAWINGS

FIG. 8 is a sectional elevation view as seen substantially from the position 8—8 of FIG. 6;

FIG. 9 is a fragmentary enlargement of the encircled area in FIG. 8;

FIG. 10 is a horizontal sectional view as seen substantially from the position 10—10 in FIG. 6;

FIG. 12 is a sectional view as seen substantially from the position 12—12 of FIG. 11;

FIG. 13 is a sectional view as seen substantially from the position 13—13 of FIG. 11;

FIG. 17 is a perspective view of a glass block corner panel arrangement in accordance with a feature of the invention;

FIG. 18 is a sectional view as seen substantially from the position 18—18 of FIG. 17;

FIG. 19 is a fragmentary sectional view similar to FIG. 18 and illustrating an alternative modification thereof;

FIG. 25 is a fragmentary perspective view of a panel construction in accordance with another alternative embodiment of the invention;

FIG. 26 is a perspective view of an assembly clip utilized with the embodiment of FIG. 25;

FIG. 27 is a sectional view as seen substantially from the position 27—27 of FIG. 26;

FIG. 28 is a top plan view of the clip of FIG. 26;

FIG. 29 is a bottom plan view of the clip of FIG. 26;

FIGS. 30 and 31 are fragmentary perspective views illustrating sequential fabrication steps in assemblying the panel utilizing the construction shown in FIG. 25;

FIGS. 32 and 33 are perspective and underside plan views respectively of a first between-block molding insert utilized in the assembly of FIG. 31; and FIGS. 34 and 35 are perspective and underside plan views respectively of a second between-block molding insert utilized in the assembly of FIG. 31.

DESCRIPTION OF PREFERRED EMBODIMENTS

Figure 1:
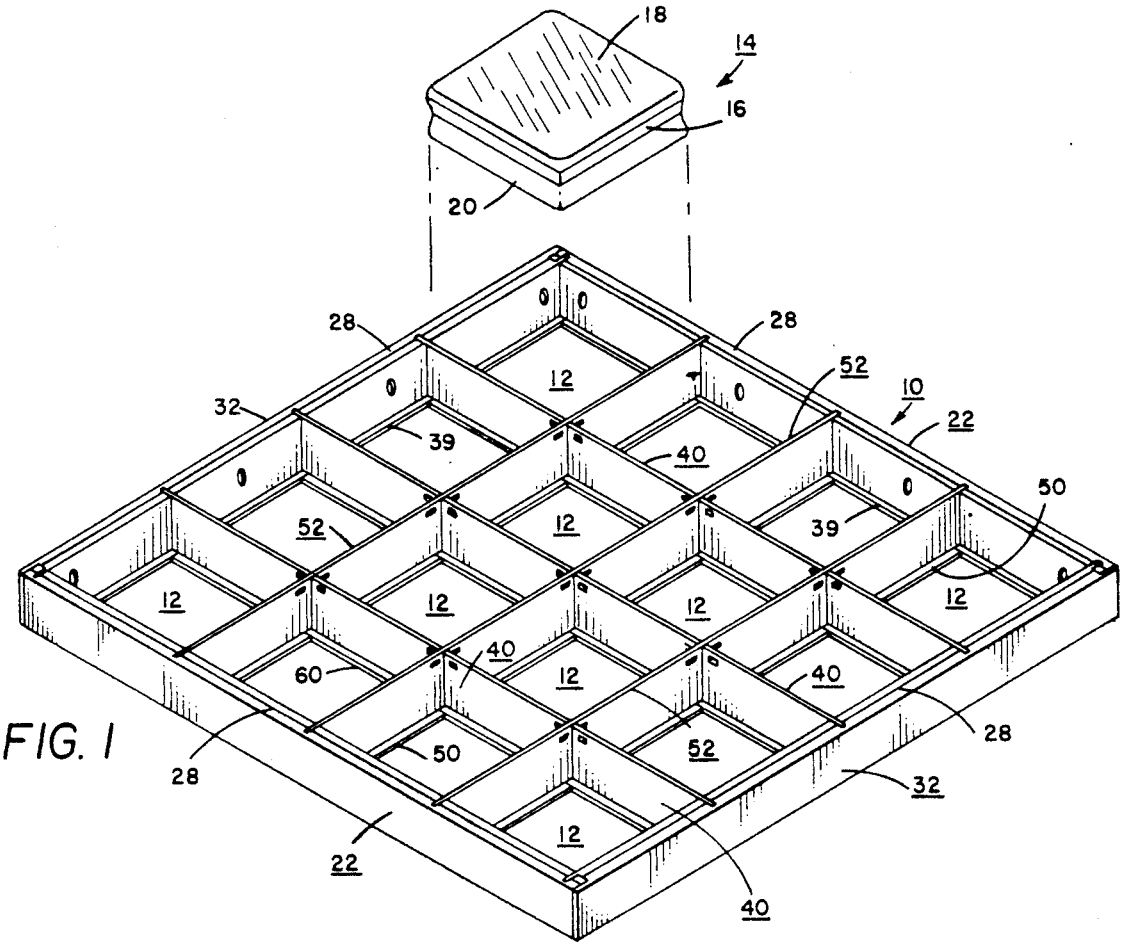
FIG. 1 is a topside isometric view of the support frame for assembling a glass block panel in accordance with the invention.
Figure 2:
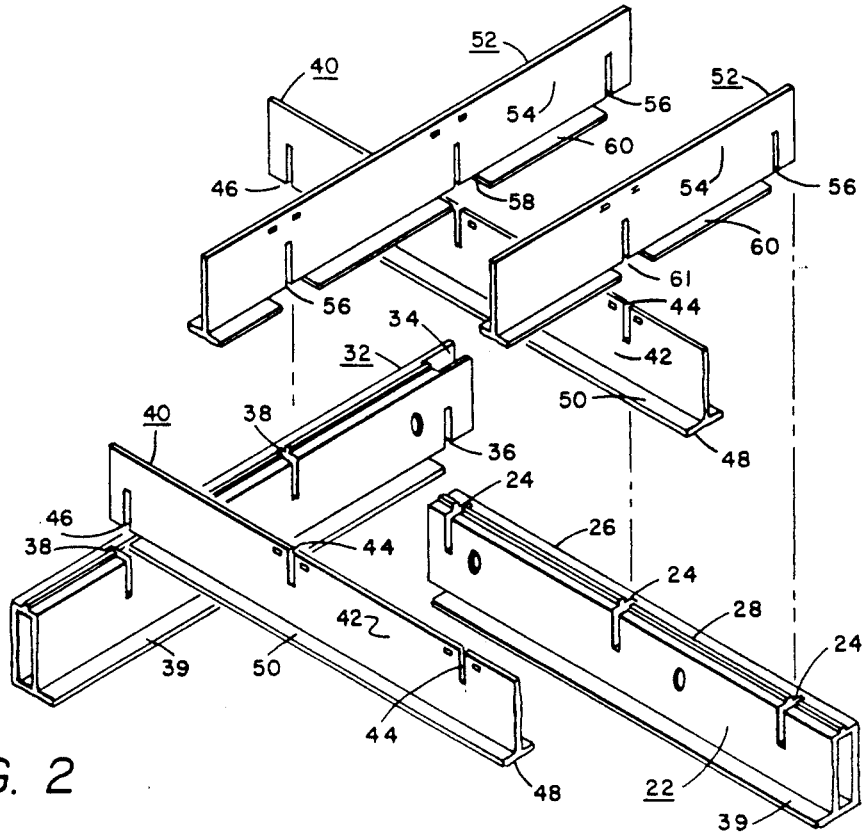
FIG. 2 is a fragmentary enlargement of the frame of FIG. 1 with the frame components illustrated in an exploded relation.
Figure 3:
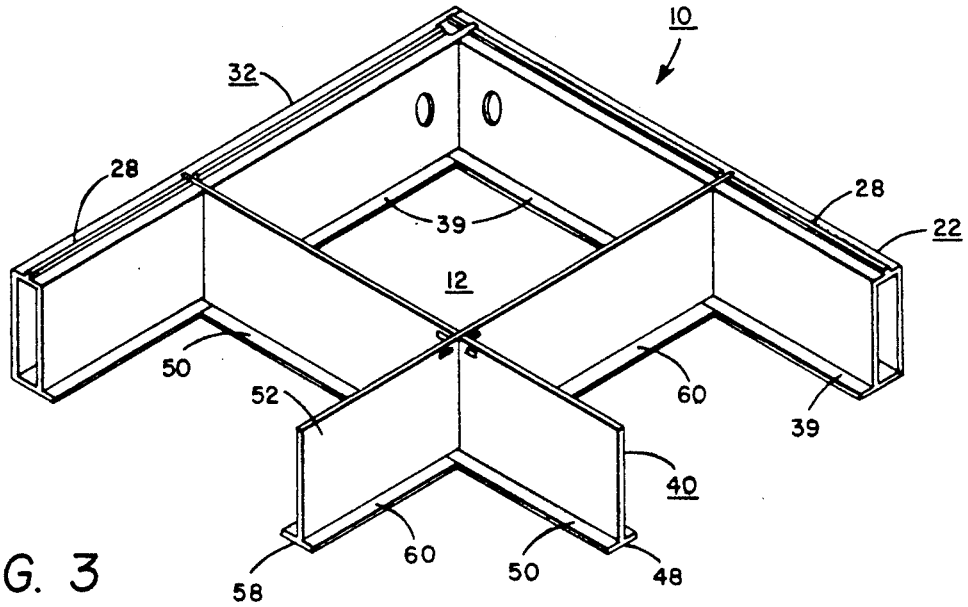
FIG. 3 is an isometric view corner enlargement of the support frame of FIG. 1.
Figure 4:
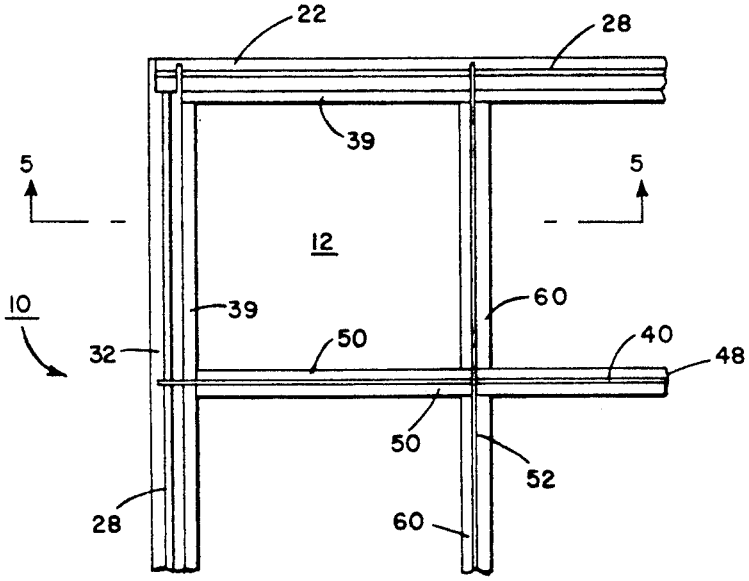
FIG. 4 is a topside plan view of the support frame corner segment of FIG. 3.
Figure 5:
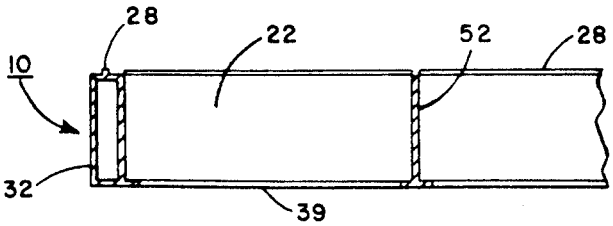
FIG. 5 is a sectional view as seen substantially from the position 5—5 of FIG. 4.

In the description which follows, like parts are marked throughout the specification and drawings with the same reference numerals respectively. The drawing figures are not necessarily to scale and the proportions of certain parts may have been exaggerated for purposes of clarity.

Referring initially to FIGS. 1–5, there is now described the fabrication of a glass block panel in accordance with the invention, in this example for a window assembly. Accordingly, this fabrication is effected by first forming a tray-like grid pattern support frame, designated in the drawings by the reference numeral 10, of suitable dimension and configuration corresponding to the panel desired to be constructed. The completed support frame defines a plurality of matrix clustered adjacently disposed pockets 12, each pocket dimensioned so as to closely receive a glass block 14 of known dimension which is suitably inserted front-to-back therein.

Glass block 14 (FIG. 1) is of the conventional type available from various commercial sources, such as Pittsburgh-Corning, in a variety of different sizes and shapes. For the purpose subsequently described, a resilient stabilizing ring 16 formed of self stick closed-cell vinyl foam, for example, may be placed in a ribbon wrap encircling the glass block at the intersection of the sloping sides and at an intermediate location between the front face 18 and the rear face 20 thereof.

Frame 10, which can be prefabricated before transport to the installation site or constructed on-site, as desired, comprises a plurality of transversely intersecting members 40 and 52, preferably of metal, surrounded by perimeter frame members 22 and 32, the entire assembly being so constructed to preferably interfit together to form the matrix of pockets 12 in which the glass blocks 14 are to be supported.

Figure 6:
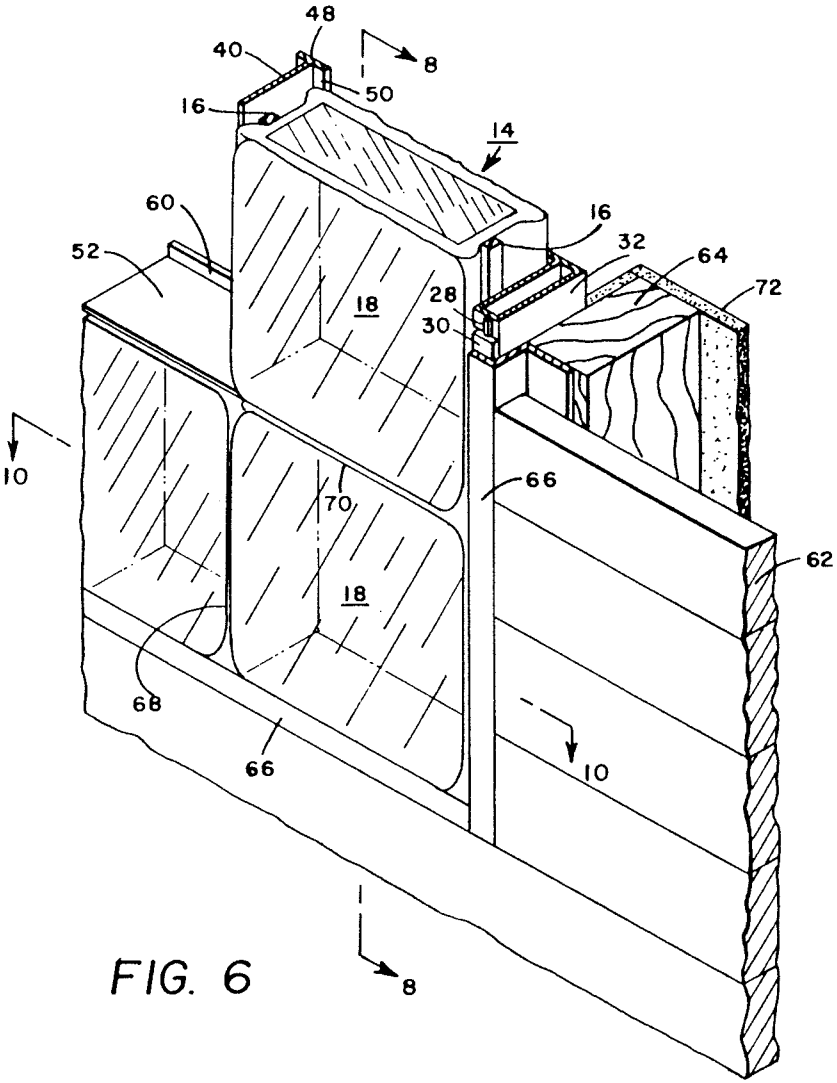
FIG. 6 is an isometric exterior front elevation view of a fragmentary portion of the glass block panel of the invention installed as a window in a building structure.

In the preferred embodiment, the transversely intersecting members of the frame forming the grid configuration are prefabricated of longitudinal partition bars adapted to effect a rigid and sturdy mechanical interlock with one another and with the surrounding perimeter members. The perimeter members 22 and 32 form a peripheral border about the assembly to cooperate internally with the partition bars (40, 52) in defining pockets 12 for supporting the inserted blocks 14. About its exterior, the perimeter bars abut an opening in the intended wall structure with which the panel is adapted to be installed, an example being a window panel assembly as shown in FIG. 6.

More specifically, the periphery of the frame 10 comprises a first pair of interchangeable parallel longitudinal, perimeter bars 22, preferably tubular and of rectangular cross section, each bar 22 having a plurality of longitudinally spaced vertical slots 24 opening downwardly from the top surface 26. Longitudinal ridges 28 are formed at the top surface 26 between the slots 24. In the case of the window assembly depicted in FIGS. 6–10, complementary strips 30 (FIG. 9) of elastomeric vapor barrier composition material are fitted over ridges 28.

For transverse joinder with bars 22 to form the frame periphery, there is also provided a second pair of interchangeable longitudinal, and preferably tubular, perimeter bars 32, each bar 32 including at its ends an internal recess 34 in a bifurcated U-shaped formation. In a manner similar to that described with respect to perimeter bars 22, longitudinal ridges 28 are also formed at the top surface of bars 32 (FIG. 3) for intersection with the ridge 28 on bars 22, thus forming a circumferential ridge around the periphery of the assembled frame.

Near each end of the bar 32, vertical underslots 36 are provided to cooperate and interfit with end slots 24 of bars 22 to effect a mechanical joinder therewith, while vertical slots 38 are provided at the top surface of each bar 32 to receive the transverse partition bars 40, as will be subsequently described.

Each of the perimeter bars (22, 32) includes a longitudinally extending, lateral lip 39 at its base adapted to protrude inward of the defined pockets 12, thereby essentially defining a shelf support upon which each inserted glass block 14 can sit.

For forming the grid-like pattern defining the plurality of individual recessed pockets 12, a plurality of first partition bars 40 are provided, each bar 40 being formed of a longitudinal flat stock member 42 with a transverse flange 48. Bars 40 extend parallel to, and intermediate, spaced perimeter bars 22 and are adapted to be connected with perimeter bars 32.

Each partition bar 40 has a plurality of longitudinally spaced vertical slots 44 extending downwardly from, and open at, its upper edge with underside vertical slots 46 being provided at each end for interlocking with the slots 38 of perimeter bars 32. Flange 48 provides dual lateral shelf lips 50 on each side of the flat member 42 so that when partition bar 40 is connected to perimeter bar 32, the lips 50 are coplanar with lips 39.

Adapted to transversely intersect, and be connected with the partition bars 40 and the perimeter bars 22 are a second plurality of partition bars 52 extending parallel to and intermediate spaced perimeter bars 32. Partition bars 52, like bars 40, are formed of flat stock 54 and include a plurality of spaced apart underside slots 56 adapted to cooperate and interfit with slots 24 of perimeter bars 22 and slots 44 of partition bars 40, in effecting a mechanical gridlock therewith.

Extending along the underside of bar 52 are transverse flanges 58 which define dual sided lateral lips 60 separated by interruptions 61. As before, when partition bars 52 are fitted together with perimeter bars 22 and transverse bars 40, the lips 60 are co-planar with lips 39 and 50, the lips 39, 50, and 60 thus defining a common shelf-lip support plane within, and around the circumference of, each of the pockets 12 defined by the frame.

Figure 7:
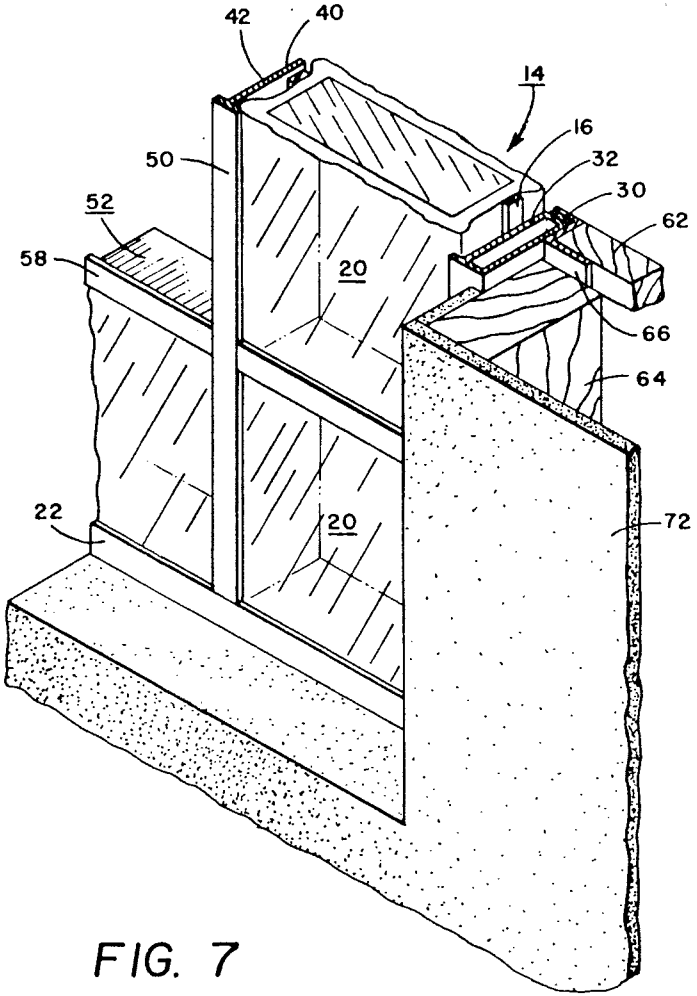
FIG. 7 is an isometric interior rear elevation view of the panel portions of FIG. 6.

Once frame 10 has been assembled, its installation as a window or wall section, for example, can be completed, as will now be described with particular reference to FIGS. 6-10. With at least perimeter bars 22 and 32 assembled together, the frame is securely disposed within the confines of a framing construction 62 of a building wall, as shown in FIGS. 6 and 7. Within the wall there is provided a suitably sized opening defined by framing studs 64 to receive and support the frame 10 and to which the frame is securely attached by screws or nails. A sealed exterior enclosure about the perimeter bars is achieved by means of longitudinal Z-bars 66 which compressively abut vapor barrier strip 30 and are secured inwardly of siding 62 to the edge of studs 64. With the assembled frame 10 completely secured in place, the glass blocks 14 are respectively inserted into the pockets 12 until they are seated against the common shelf plane defined by lips 39, 50, 60 of the cooperating bars of the frame. Compressed stabilizing ring gasket 16 serves to center the block within its placed cavity and stabilize its retention.

Following insertion of the glass blocks, there remains narrow intervening gaps 68 (FIG. 6) between the edges of the framing and the glass blocks and between the end blocks and Z-bars 66. These gaps are filled with caulking 70 in order to bond the blocks to the same grid (and to one another) and render the installation completely weatherproofed throughout.

Figure 11:
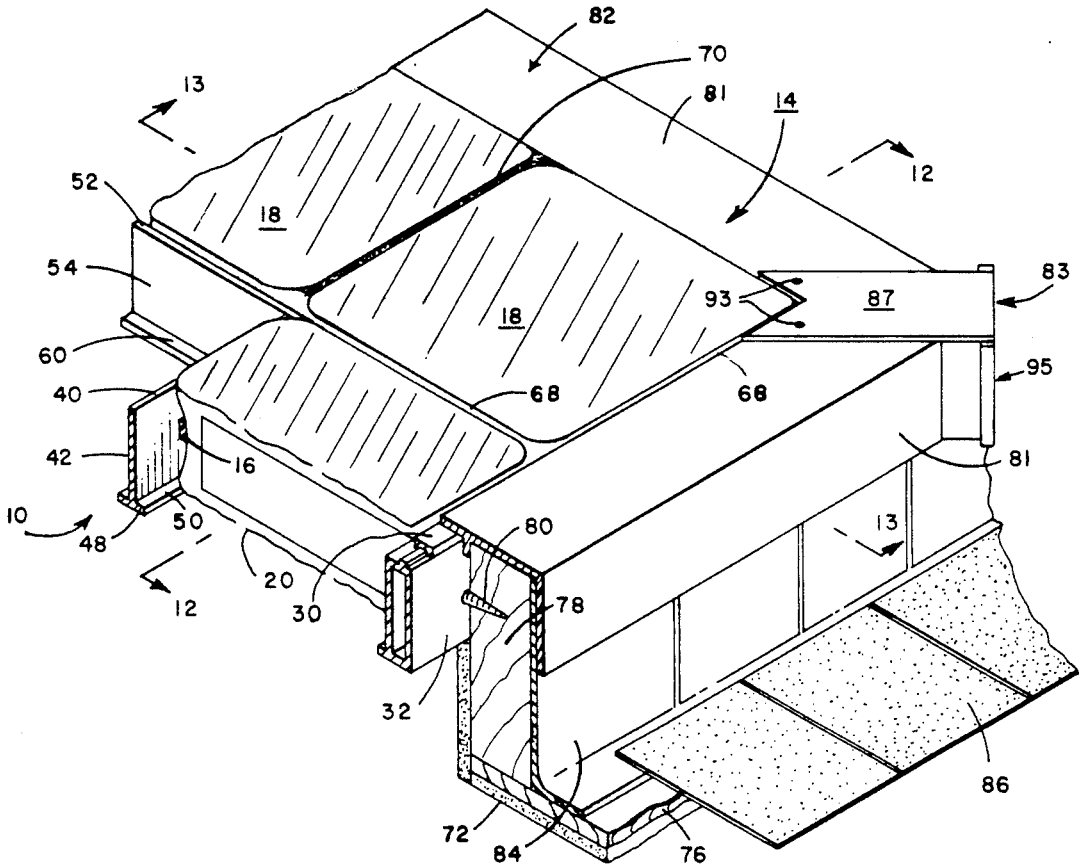
FIG. 11 is an isometric topside view of an installed skylight constructed in accordance with the invention.
Figure 14:
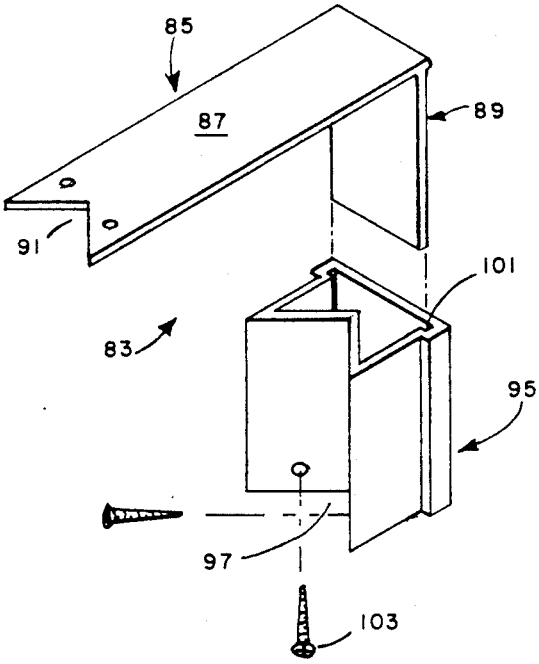
FIG. 14 is a perspective enlargement illustrating the joinder clip of FIG. 11 in exploded relation.

Referring now to FIGS. 11-14, the panel assembly of the invention is illustrated for use as a skylight. As illustrated, opening 74 in a roof structure 76 is defined by woodframing 78 to which perimeter frame bars 22 and 32 can be secured by lateral screws 80. Once set in place, a substantially F-shaped exterior frame 82 (FIG. 11) is placed thereover so as to extend about the frame 10 in a compressive relation against the vapor barrier strip 30 while embracing flashing 84 (FIGS. 11, 13). With roof shingles 86 in place, installation of the frame 10 with supported glass blocks 14 is essentially completed except for interior wallboard 72 which can be applied as appropriate. The use of the panel assembly as a skylight is facilitated by the fact that each block 14 is seated within its receptive pocket 12, rests on the support plane defined by the inwardly protruding shelf lips of the framing bars, and is secured by the overall structural integrity of the interlocking support frame 10. Being supported in this manner, the blocks remain fixedly secured within the frame, and are thus prevented from falling into the exposed space 74 below.

Frame 82 can be constructed of separate L-shaped bars 81 welded together in a right angle relation at their mitered corners. Preferably, bars 81 are secured together in their right angle relation utilizing the two component clip 83 illustrated in FIGS. 11 and 14.

Comprising one component of clip 83 is an L-shaped brace 85 including a first leg 87 and an offset second leg 89. The distal end of leg 87 includes a right angle recess 91. When leg 87 is placed overlying the mitered ends of bars 81 and secured to the bars by screws 93, recess 91 will extend coincident with the corner opening defined by the intersecting interior flanges of the bars 81.

Cooperating with brace 85 for completing the joint is an M-shaped sleeve 95 including a right angle recess 97 in which to receive the mitered joint and a narrow transverse slot 101 in which to receive leg 89 of brace 85. When assembled and placed against the joint in the manner illustrated in FIG. 14, the clip 83 can be secured to the bars 81 by means of screws 103. Caulking can then be applied as appropriate to seal the joint against the weather elements.

Figure 15:
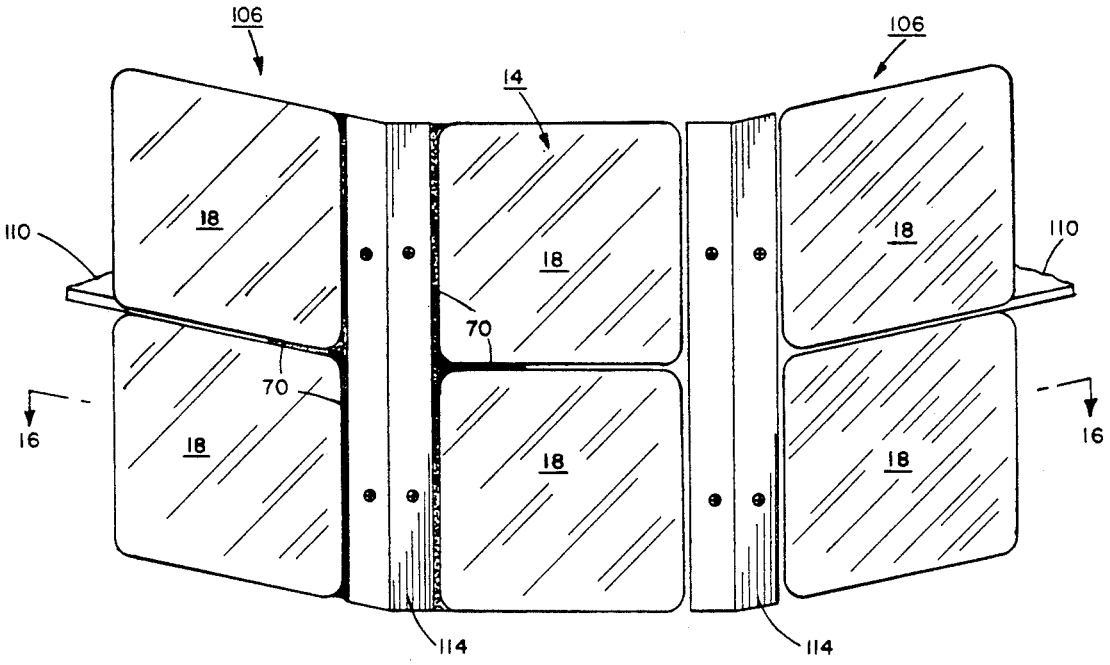
FIG. 15 is a fragmentary front elevation of a partial glass block panel of an arcuately formed embodiment of the invention.
Figure 16:
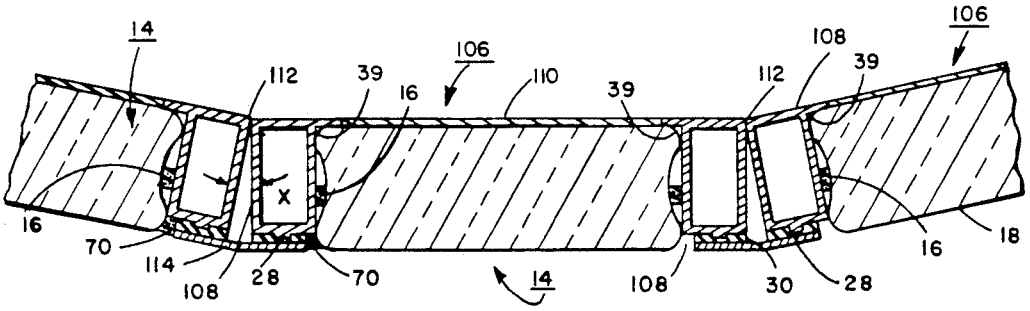
FIG. 16 is a sectional view as seen substantially from the position 16—16 of FIG. 15.

There is now described the panel assembly of the invention, but modified, as depicted in FIGS. 15 and 16, to provide an arcuate construction.

Accordingly, each separate panel section 106 is formed of spaced apart vertically parallel perimeter bars 108 (FIG. 16) joined together by way of horizontal partition bars 110 (one shown). The partition bars 110 span the individual adjacent panel sections 106 for securing them in a substantially contiguous contact vertically along their inner corners 112. Each section 106 is placed together at about the joint area to effect a divergence between the adjacent bars 108 toward the front face at an angle X. At the frontal face, each of the vapor barrier strips 30 on ridges 28 are compressed by an angled panel strip 114 (secured by screws, not shown)

spanning the intervening space and supplemented with caulking 70, as above (FIG. 15).

Where it is desired to install multiple panels 10 in a right angled corner relation to each they can be arranged in the manner illustrated in FIGS. 17 and 18. Accordingly, the two panels 10 are placed in a supported position in right angle contact along their vertical corners 116. For enclosing the frontal corner, there is provided a right angle panel strip 118, which is secured in place, so as to compress vapor barrier strips 30. Extending laterally inward from the panel strip 118 are a pair of elongated vertical strips 120 and 122 extending inwardly (beyond strips 30) in substantial surface contact with perimeter bars 22, 32, thus enhancing the stability of the installation.

For the modification of FIG. 19, a box corner panel 124 is substituted for the corner panel 118. Box panel 124 includes interior sidewalls 126 and 128 engaging the entire side surface of the intersecting perimeter bars 22, 32 to further enhance overall stability.

Figures 20, 21, 22, 23, 24:
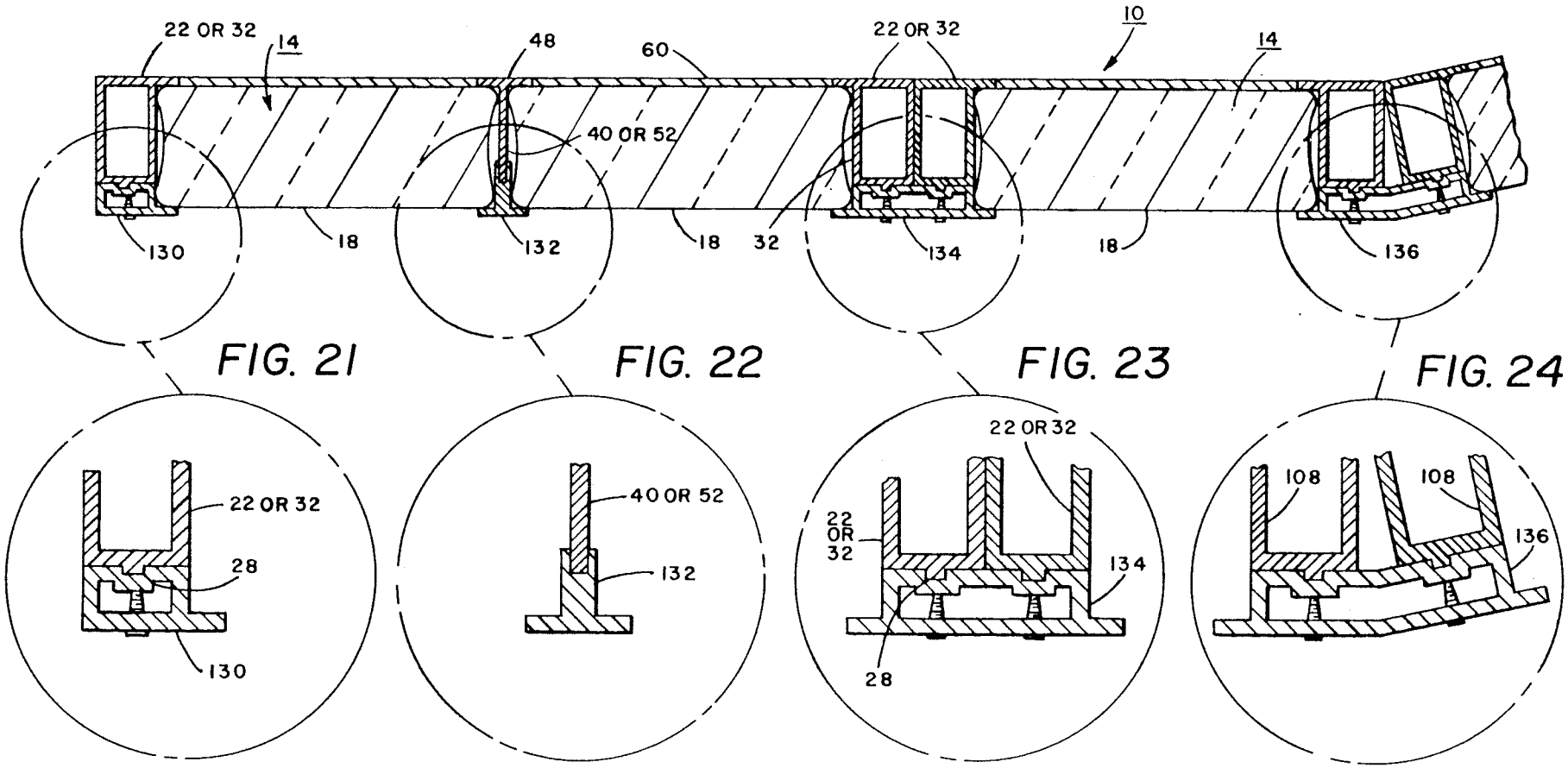
FIG. 20 is a sectional view of a panel construction in accordance with an alternate embodiment of the invention.
FIGS. 21, 22, 23 and 24 are fragmentary enlargements of their respective encircled areas in FIG. 20.

When utilizing the panel 10 of the invention for an internal wall, it is of course unnecessary to seal or insulate against ambient conditions such as humidity and temperature. Such a panel can therefore be assembled utilizing some or all of the features shown in FIGS. 20–24. As therein illustrated, end perimeter bars 22, 32 can be capped on the frontal side by a complementary fitting front panel strip 130 (secured by screws), as illustrated in FIG. 21. For interfitting the partition bars 40, 52 which intervene between adjacent blocks 14, there is provided a T-shaped bifurcated panel 132, as illustrated in FIG. 22. Where adjacent panels are contiguously juxtaposed they can be frontally enclosed by a double width cap strip 134 interfitting over adjacent blocks and appropriately secured. The cap strip in this arrangement form-fits with the upper face of the adjacent perimeter bars 22, 32, as illustrated in FIG. 23. For an angled or simulated arcuate offset similar to that previously described with respect to FIG. 16, adjacent perimeter bars 108 can be secured together at their frontal face by a form fitting angled cap strip 136, as illustrated in FIG. 24.

For an alternative to the panel assembly in FIG. 22, and useful in internal applications, reference is made to the embodiment illustrated in FIGS. 25–35. In this embodiment, the partition bars 40 and 52 each include rectangular slots 140 adjacent either side of the intersection near the distal edge of their face. To effect a four-sided embrace about the intersection there is provided an elongated cross slotted brace 142. At the first or upper end 143 of the brace, each corner of slot 146 communicates at its terminal end with oval shaped recessed indentations 144. Extending inwardly from the bottom corner of lower face 147 is a corresponding cross slot 148 adapted for placement over the intersection of the partition bars 40 and 52 and including friction indentations 149. Positioning the brace 142 by insertion over the protrusions of partition bars produces an interfit therewith, in the manner illustrated in FIG. 30, with the slots 146 aligning with the intervening gap spacing between adjacent blocks 14. A friction protrusion 149 engaging bar slots 140 affords resilient stability to the brace 142.

The remaining of the intervening frontal spaces between adjacent blocks 14 are then filled horizontally by elongated panel strips 152. Each of the strips 152 has a smooth exterior face 154 and an elongated resilient rib 156 extending laterally from its underside and having a longitudinal oval-shaped enlarged end face 158 of resilient composition extending its entire length.

A panel strip 160 is provided for each of the vertical spaces between adjacent blocks and is of similar, but longer, construction as the panels 152. From an exterior face 162 on panel 160 a laterally outward elongated rib 164 extends from its underside to an oval-shaped enlarged end face 166 of resilient composition longitudinally extending the length of rib 164. Insertion of the panel strips 152 and 160 into assembly position provides a decorative molding effect, as illustrated in FIGS. 30 and 31, with the elastomeric oval heads 158 and 166 interfitting between the blocks 14 and within the clip indentations 144.

There has thus been disclosed a novel construction for utilizing glass block panel assemblies utilized in various manners and for different purposes. By virtue of the relative simplicity in construction afforded hereby, the glass block panel can be fabricated and installed in a fraction of the time required for comparable masonry construction. Since typical savings of 50–75% in labor cost and time can be realized, not only does the invention result in less expensive installation, but the construction thereof provides substantially greater structural integrity less prone to the known problems typically associated with masonry type installations. Because of the increased structural integrity of the end product, it lends itself to a variety of applications considered impossible or impractical by prior known construction procedures. Since the versatility which it affords is significantly enhanced, the panel construction hereof can be readily adapted for interior walls, exterior walls, skylights, windows, etc. wherever the beauty and aesthetics of a glass block construction can be appreciated.

Although preferred embodiments of the invention have been described in detail, it is to be understood that various changes, substitutions, and alterations can be made thereto without departing from the spirit and scope of the invention as defined by the appended claims.

I claim:

1. A glass-block panel comprising:

a frame of relatively rigid components configured in a grid-like pattern of selected dimension, said frame including a perimeter formed from first and second pairs of interchangeable parallel longitudinal perimeter bars interlocked at ends thereof to form a peripheral border, said perimeter bars each having a tubular rectangular cross-section, and said frame further including first and second pluralities of partition bars in cooperation with said peripheral border, said first plurality of partition bars extending parallel to and intermediate said first pair of perimeter bars, and said second plurality of partition bars extending parallel to and intermediate said second pair of perimeter bars;

said pattern defining a plurality of adjacent pockets each sized for receipt of an individual glass block of known dimension; and a glass block having a rear face and disposed within each of the grid pockets to collectively comprise a panel.

2. A panel as defined in claim 1 including a sealing composition exposed about front spaces intervening in block contact between adjacent ones of said blocks in said pockets.

3. A panel as defined in claim 1 in which said grid pockets are operably effective to support a block therein about the majority of faces defining the received block.

4. A panel as defined in claim 2 in which said sealing composition comprises caulking.

5. A panel as defined in claim 1 in which said frame defines a simulated arcuate span in at least one direction in which it extends.

6. A panel as defined in claim 5 in which front edge spacing between adjacent of said blocks is substantially filled by an elongated closure cap interfitting with the components of said frame effecting separation of adjacent ones of said pockets.

7. A panel as defined in claim 6 in which at least a seam formed between said closure cap and the blocks effecting said spacing is sealed.

8. A skylight for installation over a roof opening of a building structure comprising:

a frame of relatively rigid components configured in a grid-like pattern of selected dimension, said frame including a perimeter formed from first and second pairs of interchangeable parallel longitudinal perimeter bars interlocked at ends thereof to form a peripheral border, said perimeter bars each having a tubular rectangular cross-section, and said frame further including first and second pluralities of partition bars in cooperation with said peripheral border, said first plurality of partition bars extending parallel to and intermediate said first pair of perimeter bars, and said second plurality of partition bars extending parallel to and intermediate said second pair of perimeter bars;

said pattern defining a plurality of adjacent pockets each sized for receipt and support of an individual glass block of known dimension;

a glass block disposed within each of the grid pockets to collectively comprise a window; and mounting means extending about the periphery of said frame to effect mounting over a roof opening provided therefor.

9. A skylight as defined in claim 8 including a sealing composition exposed about top spaced intervening in block contact between adjacent of said blocks in said pockets.

10. A skylight as defined in claim 8 in which said grid pockets are operably effective to support a block therein about the majority of faces defining the received block.

11. A skylight as defined in claim 9 in which the pocket support for the underface of a received block is comprised of a peripheral shelf protruding in a common plane from the frame components defining the respective pocket to inward of the support plane thereat.

12. A skylight as defined in claim 9 in which said sealing composition comprises caulking.

13. A glass-block panel, comprising:

a perimeter formed from first and second pairs of interchangeable parallel longitudinal perimeter bars interlocked at ends thereof to form a peripheral border;

said perimeter bars each having a tubular rectangular cross-section including a top surface and a base, a plurality of longitudinally spaced vertical slots opening downwardly from said top surface, a longitudinal ridge formed at said top surface between said vertical slots, and a longitudinally extending lateral lip at said base protruding inwardly therefrom;

each of said first pair of said perimeter bars having end slot ones of said vertical slots located in close proximity to said ends thereof;

each of said second pair of said perimeter bars having internal recesses of bifurcated U-shaped formation at said ends thereof, with vertical underslots provided at each of said internal recesses for interfitting engagement with said end slots of said first pair of perimeter bars;

first and second pluralities of partition bars in cooperation with said peripheral border, said first plurality of partition bars extending parallel to and intermediate said first pair of perimeter bars, and said second plurality of partition bars extending parallel to and intermediate said second pair of perimeter bars, to form a grid-like pattern defining a plurality of individual recessed pockets;

each said partition bar including a longitudinal flat stock member, an upper edge, a transverse flange, and two ends, with said flange providing dual lateral shelf lips on each side of said flat stock member;

each of said first plurality of partition bars having a plurality of longitudinally spaced vertical slots extending downwardly from, and open at, said upper edge, and having an underside vertical slot at each of said ends interlocked with one of said slots of said second pair of perimeter bars;

each of said second plurality of partition bars having a plurality of spaced apart underside vertical slots interfitted with said vertical slots of said first plurality of partition bars, and having an underside vertical slot at each of said ends interlocked with one of said slots of said first pair of perimeter bars, with said flange being separated by interruptions;

said lips of said perimeter and partition bars being coplanar and defining a common shelf lip support plane within each of said pockets; and a rectangular glass block inserted into each said pocket in contact with said shelf lips, with at least one compressed resilient stabilizing ring gasket interfitted between each said glass block and each said pocket to seal and stabilize said glass block within said pocket.

14. A method for fabricating a glass block panel comprising the steps of:

forming a frame of relatively rigid components in a grid-like pattern of selected configuration and dimension, said frame including a perimeter formed from first and second pairs of interchangeable parallel longitudinal perimeter bars interlocked at ends thereof to form a peripheral border, said perimeter bars each having a tubular rectangular cross-section, and said frame further including first and second pluralities of partition bars in cooperation with said peripheral border, said first plurality of partition bars extending parallel to and intermediate said first pair of perimeter bars, and said second plurality of partition bars extending parallel to and intermediate said second pair of perimeter bars;

said pattern defining a plurality of adjacent pockets each sized to closely receive an individual glass block to be utilized in collectively forming the complete panel;

inserting a glass block within each of the grid pockets to be utilized; and enclosing front spacings intervening between adjacent ones of the inserted blocks.

* * * * *

UNITED STATES PATENT AND TRADEMARK OFFICE

CERTIFICATE OF CORRECTION

PATENT NO. : 5,042,210

DATED : August 27, 1991

INVENTOR(S) : John R. Taylor

It is certified that error appears in the above-identified patent and that said Letters Patent is hereby corrected as shown below:

In the claims:

Column 9, line 42, "spaced" should read "spaces".

Signed and Sealed this

Sixth Day of October, 1992

*Attest:*

DOUGLAS B. COMER

*Attesting Officer*

*Acting Commissioner of Patents and Trademarks*